US008713875B2

(12) United States Patent
Loomis et al.

(10) Patent No.: US 8,713,875 B2
(45) Date of Patent: May 6, 2014

(54) BLAST RESISTANT GLASS BLOCK PANEL

(75) Inventors: Nicholas T. Loomis, Pittsburgh, PA (US); Peter R. Atherton, Export, PA (US)

(73) Assignee: Pittsburgh Corning Corporation, Pittsburgh, PA (US)

( * ) Notice: Subject to any disclaimer, the term of this patent is extended or adjusted under 35 U.S.C. 154(b) by 0 days.

(21) Appl. No.: 13/359,474

(22) Filed: Jan. 26, 2012

(65) Prior Publication Data

US 2012/0125186 A1 May 24, 2012

Related U.S. Application Data

(63) Continuation of application No. 12/421,531, filed on Apr. 9, 2009, now abandoned.

(60) Provisional application No. 61/043,959, filed on Apr. 10, 2008.

(51) Int. Cl.
*E04B 5/46* (2006.01)
*E04C 2/54* (2006.01)

(52) U.S. Cl.
CPC ..... *E04C 2/546* (2013.01)
USPC ..... 52/308; 52/656.5

(58) Field of Classification Search
USPC ..... 52/306, 307, 308, 656.2, 656.5
See application file for complete search history.

(56) References Cited

U.S. PATENT DOCUMENTS

| | | | | | |
|---|---|---|---|---|---|
| 2,182,373 | A * | 12/1939 | Cox | 52/477 |
| 4,058,943 | A * | 11/1977 | Sturgill | 52/223.7 |
| 4,986,048 | A * | 1/1991 | McMarlin | 52/306 |
| 5,448,864 | A * | 9/1995 | Rosamond | 52/307 |
| 5,485,702 | A * | 1/1996 | Sholton | 52/308 |
| 5,907,937 | A * | 6/1999 | Loftus et al. | 52/308 |
| 5,992,111 | A * | 11/1999 | Waterhouse | 52/308 |
| 6,675,543 | B2 * | 1/2004 | LeMert | 52/308 |
| 7,373,763 | B2 * | 5/2008 | Voegele et al. | 52/308 |
| 7,640,712 | B1 * | 1/2010 | Eshelman | 52/846 |
| 7,877,947 | B2 * | 2/2011 | Borressen et al. | 52/306 |
| 8,154,788 | B2 * | 4/2012 | Millett et al. | 359/288 |
| 8,236,415 | B2 | 8/2012 | Hojaji et al. | |
| 2003/0005655 | A1 * | 1/2003 | LeMert | 52/308 |
| 2004/0177577 | A1 * | 9/2004 | Voegele et al. | 52/306 |

* cited by examiner

*Primary Examiner* — William Gilbert
*Assistant Examiner* — Gisele Ford
(74) *Attorney, Agent, or Firm* — Reed Smith LLP

(57) ABSTRACT

A glass block panel assembled, framed and attached to a substrate such that it resists the shock wave resulting from a blast event.

10 Claims, 2 Drawing Sheets

SECTION A-A

BLAST RESISTANT GLASS BLOCK PANEL

PRIOR APPLICATION

This application is a continuation and claims the benefit under 35 U.S.C. §120 of U.S. patent application Ser. No. 12/421,531, filed Apr. 9, 2009, the contents of which are hereby incorporated by reference, which itself claims the benefit under 35 U.S.C. §119(e) of the earlier filing date of U.S. Provisional Application No. 61/043,959, filed Apr. 10, 2008, entitled "Glass Block Blast Resistance System".

BACKGROUND OF THE INVENTION

1. Field of the Invention

The present invention relates to architectural glass block panels and windows ("panels") and methods of making such panels. More particularly, the invention relates to a glass block panel that is resistant to the shock wave effects of a blast event, for example, an explosion.

2. Background of the Invention

Glass blocks may be used instead of solid (i.e., non-transparent) materials, plate glass or other fenestration materials in the construction of walls and partitions. Aside from the aesthetic advantages that the glass blocks may provide over other solid or glass materials, the glass blocks may be preferable because they are transparent and allow light to filter through, thereby permitting viewing with desired levels of privacy through the wall, or creating a brighter room or office space.

With the increased threat and awareness of terrorist and criminal attacks from explosive ballistic devices, responsible government and commercial organizations are responding with more stringent building requirements along with better products and construction methods. In the past, the majority of injuries to building occupants have been caused by shattered glass fragments or shards sent flying through the air from the blast force.

An explosion will cause variations in air pressure, called shock waves, to radiate from the source of the blast. The actual effect of a blast is a function of its type, magnitude, duration and distance from where the blast took place. "Standoff distance" is a distance maintained between a building and the potential location of an explosive detonation, like a sidewalk or parking lot, by use of a fence and gated entry, where inspections for explosives are done. Standoff distances will be longer where there is potential to detonate a larger explosive device, like one driven in a car or truck, and shorter where the device could be carried. With a nearly infinite range of explosive devices and potential standoff distances, standards have been developed to simplify blast parameters for testing and application purposes. To that end, a blast pulse is often simplified to a triangular shape where the pressure rises from ambient pressure almost instantaneously and then declines linearly back to ambient.

The key parameters used to define a blast in standards and specifications for fenestration are:

- Maximum pressure is the highest level of pressure above ambient that is typically reached immediately after detonation. Measured in psi (pounds per square inch), it is often referred to as peak pressure and applied pressure. Overpressure is often used to describe pressures above ambient.
- Impulse is a function of the pressure and duration and is the area under the pressure curve from detonation to when the pressure returns to ambient. It is measured in psi-msec (pounds per square inch—milliseconds).

The other key parameter for fenestration is how well it resists a blast in order to protect people inside of a building. The two commonly used standards defining that protection are the ASTM Hazard Rating (from ASTM International, previously American Society for Testing and Materials) and the GSA Performance Condition (from the General Services Administration).

ASTM has developed a document with designation F 1642-04 titled "Standard Test Method for Glazing and Glazing Systems Subject to Airblast Loadings." It is used to define standard testing procedures and resulting "Hazard Rating." GSA is a government agency that provides support to federal, state and local government agencies and to contractors and suppliers providing goods and services to them. Part of their function is to qualify suppliers and products. For blast resistant fenestration, they provide GSA Test Protocol GSA-TS01-2003 titled "US General Services Agency Test Method for Glazing and Window Systems Subject to Dynamic Overpressure Loadings." GSA has prescribed the following Building Classifications:

| GSA Building Classification | Maximum Pressure | Impulse | Performance |
|---|---|---|---|
| Level A | 0 | 0 | NA |
| Level B | 0 | 0 | NA |
| Level C | 4 psi | 28 psi-msec | 3b or better |
| Level D | 10 psi | 89 psi-msec | 3b or better |
| Level E | Classified | Classified | per spec |

Thus, there is a need for glass construction material that provides the aesthetic and visual benefits discussed above in conjunction with increased resistance to explosive blasts. Historically, most glass block installations were done with masonry, such that the glass blocks were connected to each other with mortar or mortar-like adhesives, akin to the construction of a brick wall. With the advent of improved sealants and adhesives, however, an increasing number of glass block installations have been done with silicone, either alone or in conjunction with plastic spacer systems. One advantage the better silicones can offer over traditional mortar is that the assembled glass block panel can flex, allowing it to absorb forces from powerful air pressures caused by nature or those that are man made. While natural air pressure, such as that found in hurricanes, may be on the order of 100 pounds per square foot, air pressures for blast events may be ten to twenty times larger, sometimes approaching or even exceeding 1800 pounds per square foot. The present invention seeks to provide a glass block panel that can withstand such high pressures without any glass cracking or any loss of material.

Flat glass fenestration has made good progress in blast resistance by utilizing glass lamination and framing techniques to allow a glass pane to flex, so that even when the glass cracks, the underlying laminate layer may help hold the pane together, thereby limiting the scattering of glass fragments. The invention described herein builds on the natural structure of glass block construction to allow the fenestration to flex elastically to blast pressures. The structure behaves like a flexible web of independent glass units. Whereas laminated flat glass panes often will crack and release fragments during a blast, there is no such cracking or loss of glass with the present invention. This is particularly important to people who are in the proximity of a building when a blast event occurs because they may be pushed up against the building and underneath windows where shattered glass might be raining down on them.

Accordingly, it is an object of the present invention to provide a glass block construction material that provides the aesthetic and visual benefits of an ordinary glass or glass block panel in conjunction with increased resistance to explosive blasts.

SUMMARY OF THE INVENTION

The nature of the glass block panel allows it to flex in response to the shock wave emanating from a blast event, thus absorbing much of the force. Conceptually, this is like a trampoline mesh made up of a grid of rigid elements (the glass blocks) held together by a network of flexible elements (the silicone spacer system). The grid assembly of rigid blocks held together by a silicone spacer system is placed into a frame unit that is attached to the substrate of an opening in a building wall. It is assumed that the substrate and containing structure are robust enough to withstand the force of a blast as captured by the glass block panel.

Some preferred characteristics of this invention are:

1. The glass block system is flexible enough to absorb the pressure of an air blast.
2. The glass block system is resistant to, i.e., strong enough not to break or tear from, the pressure of an air blast.
3. The glass block is strong enough due to the quality of the glass and the thickness of the faces such that it does not break or crack from the pressure of an air blast.
4. The frame is strong enough to hold the glass block panel as it flexes from the pressure of an air blast that is absorbed by the flexing glass block system.
5. The frame is attached to the substrate of the building opening (e.g., window) in such a way that it will not give way from the pressure of an air blast that is absorbed by the flexing glass block system.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF PREFERRED EMBODIMENTS OF THE INVENTION

It is to be understood that the figures and descriptions of the present invention have been simplified to illustrate elements that are relevant for a clear understanding of the invention. The detailed description will be provided hereinbelow with reference to the attached drawings.

Figure 1:
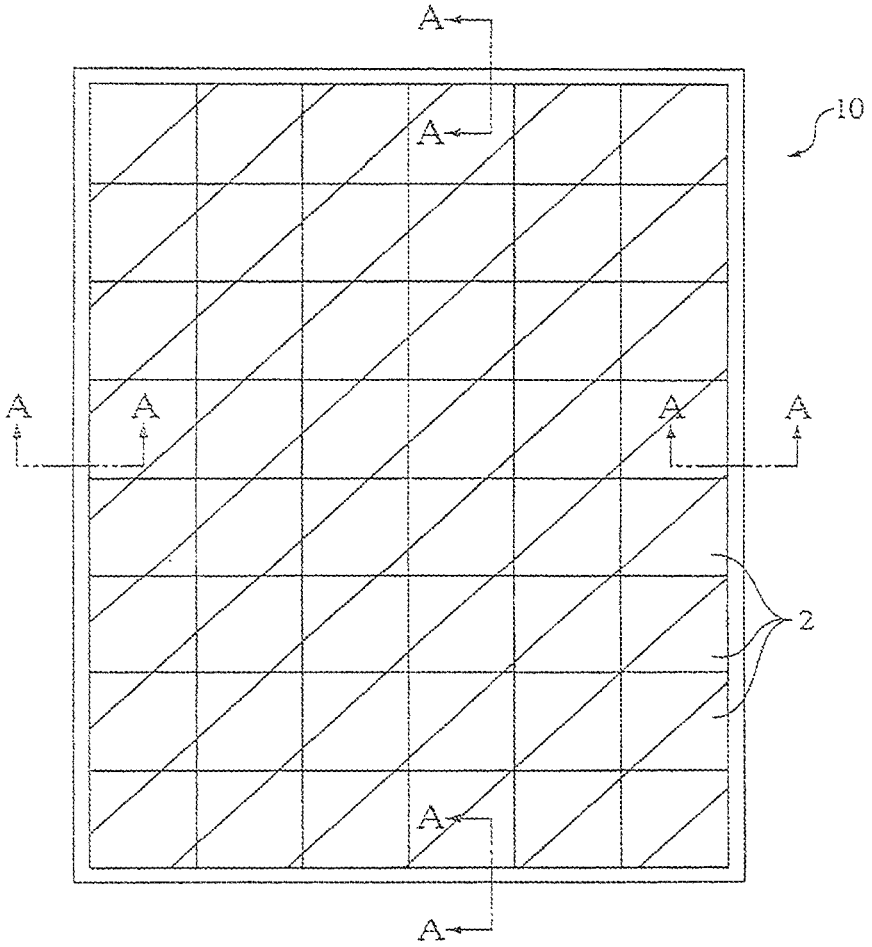
FIG. 1 illustrates an assembled glass block panel attached to a steel frame.
Figure 1A:
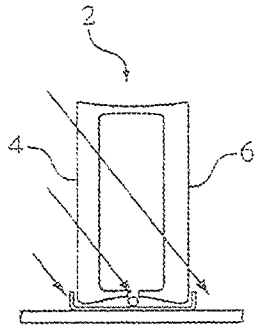
FIG. 1A illustrates a section view through A-A of FIG. 1.

Referring to FIGS. 1 and 1A, glass blocks 2 typically are on the order of 8 inches by 8 inches in dimension. Thus, a preferred embodiment of the present invention is a glass block panel 10 which may range in size from 16 inches by 16 inches (i.e., 2 blocks by 2 blocks) to 12 feet by 12 feet (i.e., 18 blocks by 18 blocks). The glass block panel 10 may take any shape but is preferably square or rectangular. The faces 4, 6 of the individual glass blocks 2 typically are on the order of ¼ inch thick, but may be thicker if higher blast pressures are anticipated. For example, in order to resist cracking from the shock wave of a high-pressure blast event, the Thickset® 90 block from Pittsburgh Corning Corporation may be used. However, one of ordinary skill in the art would recognize and understand that the precise dimensions and/or thickness of the individual blocks 2 can vary according to individual needs without departing from the scope of this invention.

Figure 2:
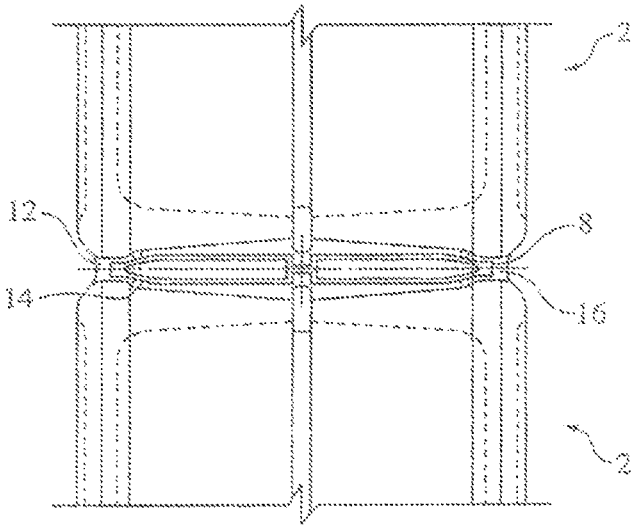
FIG. 2 illustrates joints and spacers between the individual glass blocks.

The glass block panel 10 preferably is assembled using track spacers 8 running between the blocks both horizontally and vertically as shown in FIG. 2. The spacers 8 are preferably rigid and often made of vinyl or other plastic material. The spacers 8 separate the glass blocks 2 to provide a consistent (e.g., on the order of ⅛") open joint 12 in which to provide a sealant 14. The profile of the spacers 8 make them conducive to accommodate the somewhat concave edge profile of the glass blocks 2. The longitudinal notches in the spacers 8 offer a pseudo key lock between the glass blocks 2 so that the spacers 8 and glass blocks 2 work as an integrated system to provide elastic resistance to wind loads, blast waves and high wind debris impact.

A structural silicone 16 (for example, Pittsburgh Corning Glass Block Sealant) is used to bond the spacers 8 to the adjoining glass blocks 2. A rectangular glass block panel 10 is made by progressively assembling blocks 2 and spacers 8 with the structural silicone 16 until the desired dimensions are attained. Spacers 8 may run continuously in either the horizontal or vertical direction for structural strength.

Figure 3:
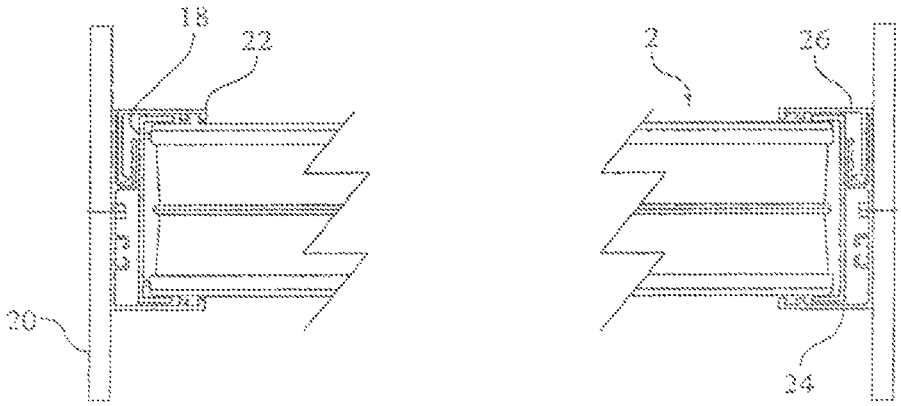
FIG. 3 illustrates the perimeter of the glass block assembly and how it fits into a frame.

A perimeter channel 18 may then be applied around the perimeter of the glass block panel also using a structural silicone 16, as shown in FIG. 3. The perimeter channel 18 can provide an extra structural element by running continuously in both horizontal and vertical directions around the assembly. It also provides protection from damage as the glass block assembly is transported and framed. The perimeter channel 18 is preferably vinyl, although other rigid plastics may be used.

The glass block assembly 10 may be framed by a metal or otherwise rigid frame 20 as illustrated in FIG. 3. In one embodiment, the glass block panel 10 preferably is placed within a two piece aluminum channel 22. The aluminum channel 22 encases the glass block window and provides a means of attachment to a window opening. One advantage of a two-piece channel is that it will enable the placement of a complete prefabricated glass block unit or several prefabricated sections to complete a glass block unit within the channel. The primary channel piece 24 is attached to a window opening (optionally via frame 20, if desired). The glass block panel 10 then fits into the primary channel piece 24, and the secondary channel piece 26 snaps, locks or is otherwise attached into place. A silicone or other sealant 14 (for example, Pittsburgh Corning Glass Block Sealant) may then be applied to the joints around the frame 20 to seal it from the elements, such as rain.

For the preferred embodiment, the thickness and alloy of aluminum used in the channel 22 should meet minimum conditions as prescribed by blasting tests and engineering analysis. For example, the glass block panels 10 of the present design with sizes ranging between 4 feet by 4 feet to 8 feet by 8 feet preferably should perform to ASTM "Minimal Hazard" or GSA "Performance Condition 2" or better for:

GSA Level C and Level D;

UFC Type I threats at 25 m and 45 m standoff distances, and Type II threats at 10 m and 25 m standoff distances.

Smaller windows would meet the same standards with a thicker aluminum frame, stronger aluminum alloys and specific anchoring requirements.

The entire glass block assembly is then attached or anchored into the desired opening, which may be steel, concrete, masonry, wood or another suitable material. For panels that are 4 feet or larger in both dimensions up to 12 feet in both dimensions, the aluminum frame is preferably 0.125-inch thick 6063 T6 alloy, and attaching the frame may be as follows:

a. Attaching to ¼-inch steel or greater, ¼-inch self drilling screw spaced at 12-inches or less; or
b. Attaching to 2000 psi concrete, ¼-inch concrete screw with 1-inch embedment with masonry anchors, such as Hilti Kwik-ConII or equivalent spaced at 9-inches or less; or
c. Attaching to concrete masonry units ¼-inch concrete screw with 1-inch embedment using a masonry anchor, such as Hilti Kwik-ConII or equivalent spaced at 8-inches or less.

For panels 32-inches by 32-inches to 4-feet by 4-feet, the aluminum frame is preferably 0.15-inch thick 6063-T6 aluminum, and attaching the frame may be as follows:

a. Attaching to ¼-inch steel or greater, ¼-inch self drilling screw spaced at 8-inches or less; or
b. Attaching to 2000 psi concrete, ¼-inch concrete screw with 1-inch embedment with masonry anchors, such as Hilti Kwik-ConII or equivalent spaced at 6-inches or less; or
c. Attaching to concrete masonry units ¼-inch concrete screw with 1-inch embedment using a masonry anchor, such as Hilti Kwik-ConII or equivalent spaced at 5.3-inches or less.

For smaller panels, the preferred requirements are as follows:

| Corning Glass Block Panel Size | Predicted Performance for UFC minimums | Frame Requirements | Anchoring Requirements |
|---|---|---|---|
| 40-in × 16-in | Elastic Response (ASTM No Hazard) (UFC High LOP) (GSA Performance Condition1) | 0.16-in thick (min) 6061 T6 Al. (fy = 35 ksi) | Metal Studs: 12-14 Biflex screws @ 6-in O.C<br>CMU: Hilti HUS-H ⅜-in × 2-¾-in Screw Anchor @ 8-in O.C<br>Concrete: Hilti HUS-H ⅜-in × 2-in Screw Anchor @ 6-in O.C |
| 32-in × 16-in | Elastic Response (ASTM No Hazard) (UFC High LOP) (GSA Performance Condition1) | 0.16-in thick (min) 6061 T6 Al. (fy = 35 ksi) | Metal Studs: 12-14 Biflex screws @ 6-in O.C<br>CMU: Hilti HUS-H 3/8-in × 2-¾-in Screw Anchor @ 8-in O.C<br>Concrete: Hilti HUS-H ⅜-in × 2-in Screw Anchor @ 6-in O.C |
| 48-in × 16-in | Elastic Response (ASTM No Hazard) (UFC High LOP) (GSA Performance Condition1) | 0.16-in thick (min) 6061 T6 Al. (fy = 35 ksi) | Metal Studs: 12-14 Biflex screws @ 6-in O.C<br>CMU: Hilti HUS-H ⅜-in × 2-¾-in Screw Anchor @ 8-in O.C<br>Concrete: Hilti HUS-H ⅜-in × 2-in Screw Anchor @ 6-in O.C |
| 32-in × 8-in | Elastic Response (ASTM No Hazard) (UFC High LOP) (GSA Performance Condition1) | 0.16-in thick (min) 6066 T6 Al. (fy = 45 ksi) | Metal Studs: 12-14 Biflex screws @ 4-in O.C<br>CMU: Hilti HUS-H ½-in × 2-¾-in Screw Anchor @ 8-in O.C<br>Concrete: Hilti HUS-H ⅜-in × 2-in Screw Anchor @ 5-in O.C |

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A blast-resistant glass block panel comprising:

a plurality of glass blocks arranged in a panel, wherein each glass block comprises a front face, a rear face, and four side walls, wherein said side walls possess a concave profile, further wherein said side walls include a protrusion that runs around the perimeter of said glass block parallel to said front face and said rear face, wherein a notch is located at the center of each side wall, each block forming a space with an adjacent block in said panel;

a rigid spacer placed in each said respective space, wherein said rigid spacers possess a convex shape that substantially corresponds the concave profile of said glass block, further wherein said spacers include a notch at the center of said spacer;

a perimeter channel disposed around a perimeter of the panel, wherein the perimeter channel has front and rear legs that extend over portions of the front and rear faces, respectively, of each said glass block defining the perimeter of the panel;

a two-piece channel disposed around said perimeter channel, wherein said two-piece channel includes a primary channel member which is adapted to be attached to a frame, and a secondary channel member which is attachable to the primary channel member, wherein the two-piece channel has front and rear legs that extend over and past the front and rear legs of the perimeter channel on said glass blocks on the perimeter of said panel; and sealant placed between each of said plurality of glass block and said rigid spacers.

2. The blast-resistant glass block panel of claim 1, wherein each of said glass block possesses a front face and a rear face having a thickness of at least ¾ inch.

3. The blast-resistant glass block panel of claim 1, wherein said rigid spacers are adapted to provide a consistent spacing between said glass block.

4. The blast-resistant glass block panel of claim 1, wherein said rigid spacers are plastic.

5. The blast-resistant glass block panel of claim 4, wherein said plastic is vinyl.

6. The blast-resistant glass block panel of claim 1, wherein said perimeter channel is plastic.

7. The blast-resistant glass block panel of claim 1, wherein said two-piece channel is metal.

8. The blast-resistant glass block panel of claim 7, wherein said metal is aluminum or an aluminum alloy.

9. The blast-resistant glass block panel of claim 1, wherein said sealant is silicone.

10. The blast-resistant glass block panel of claim 9, wherein said silicone is a structural silicone.

* * * * *